United States Patent [19]

Maude, Sr.

[11] Patent Number: 5,013,070

[45] Date of Patent: May 7, 1991

[54] GOLF SCORE CARD WITH PUTTING GREEN GRAIN INDICIA

[75] Inventor: Michael F. Maude, Sr., 25430 W. Cuba Rd., Barrington, Ill. 60010

[73] Assignee: Michael F. Maude, Sr., Barrington, Ill.

[21] Appl. No.: 537,236

[22] Filed: Jun. 13, 1990

[51] Int. Cl.[5] ..... A63B 67/02

[52] U.S. Cl. ..... 283/49; 283/48.1; 273/32 H; 434/252

[58] Field of Search ..... 283/49, 48.1; 434/252; 273/324, 32 R, 176 L, DIG. 26

[56] References Cited

U.S. PATENT DOCUMENTS 3,685,168 8/1972 Reitz ..... 273/32 H 3,805,411 4/1974 Andrews, Jr. ..... 434/252

4,419,655 12/1983 May ..... 273/176 L

*Primary Examiner*—Douglas D. Watts

*Assistant Examiner*—Hwei-Siu Payer

*Attorney, Agent, or Firm*—Dressler, Goldsmith, Shore, Sutker & Milnamow, Ltd.

[57] ABSTRACT

A golf score card includes an arrangement for assisting a player in evaluating the characteristics of the greens of a golf course. The card includes a markable substrate, such as paper or the like, to facilitate keeping score on a hole-by-hole basis. The card further includes a graphic illustration of each of the holes of the course, with the illustration including a graphic depiction of the general shape of the putting green of each hole. In order to facilitate play, graphic indicia are provided for indicating the direction of the grain of the grass on the green.

3 Claims, 2 Drawing Sheets

GOLF SCORE CARD WITH PUTTING GREEN GRAIN INDICIA

TECHNICAL FIELD

The present invention relates generally to golf playing and scoring equipment, and more particularly to an improved golf score card having a depiction of each putting green of an associated golf course, with indicia for indicating the grain of the grass of each green.

BACKGROUND OF THE INVENTION

For many years, the game of golf has proven to be a challenging sport of enduring popularity. Part of the game's appeal stems from the fact that players of all ages and abilities can participate, with all players being able to experience the challenge of any given golf course and the excitement of skillful play.

Part of the challenge of the game relates to the player's evaluation and interpretation of the geography, relative distances, hazards, and obstacles of a given golf hole. In this regard, skillful play on the putting surfaces of the course's greens requires study and evaluation of a number of different variables.

In particular, a player must evaluate the manner in which his putting stroke will be affected by the sloping surfaces of the green, its relative "speed", and the influence of the grain of the grass of the putting surface. Grain generally refers to the predominant direction in which the grass of the putting surface tends to grow.

The direction of the grain can be influenced by the green's slope, its orientation relative to the prevailing weather conditions and natural light, and the type of grass used for the putting surface. The combination of these variables sometimes results in a green exhibiting more than one direction to the grain of the grass. Moreover, the regular cutting and grooming of a green can influence the effect of the grain on putting. Specifically, cutting can increase the effect of the grain on a ball's rotation, since cutting typically results in relatively "blunt" ends of the blades of grass to be presented to the ball.

Accordingly, the present invention contemplates an arrangement whereby a player can be assisted in evaluating the grain of the grass making up the putting surface of a golf hole.

SUMMARY OF THE INVENTION

The present invention contemplates a golf score card which is uniquely configured to provide a player with guidance in evaluating the direction of the grain of the grass which makes up the putting surface of the various greens of the golf course.

To this end, the present golf card comprises a markable substrate, such as paper, cardboard, or similar material, with the substrate having a suitable arrangement thereon for keeping score during a game on a hole-by-hole basis. Preferably, the card is configured to permit scoring for several players.

The card further includes a plurality of graphic illustrations depicting the general shape of the green of each of the golf holes of the associated golf course. In the illustrated embodiment, each graphic illustration further shows the general layout of the golf hole, from tee box to green, with the optional illustration of bunkers, hazards, and other obstacles.

In accordance with the present invention, the golf card further includes at least one grain indicia associated with the graphic illustration depicting each golf green. The grain indicia may take the form of plural parallel arrows, arrowheads, or like direction indicating markings.

Depending upon the conditions of a particular green, the green may exhibit a grain which generally extends in a plurality of directions. In this instance, the present card preferably is configured to include a plurality of grain indicia markings for indicating a respective plurality of directions of the grain of the grass on the green.

Other features and advantages of the present invention will become readily apparent from the following detailed description, the accompanying drawings, and the appended claims.

DETAILED DESCRIPTION

Figure 1:
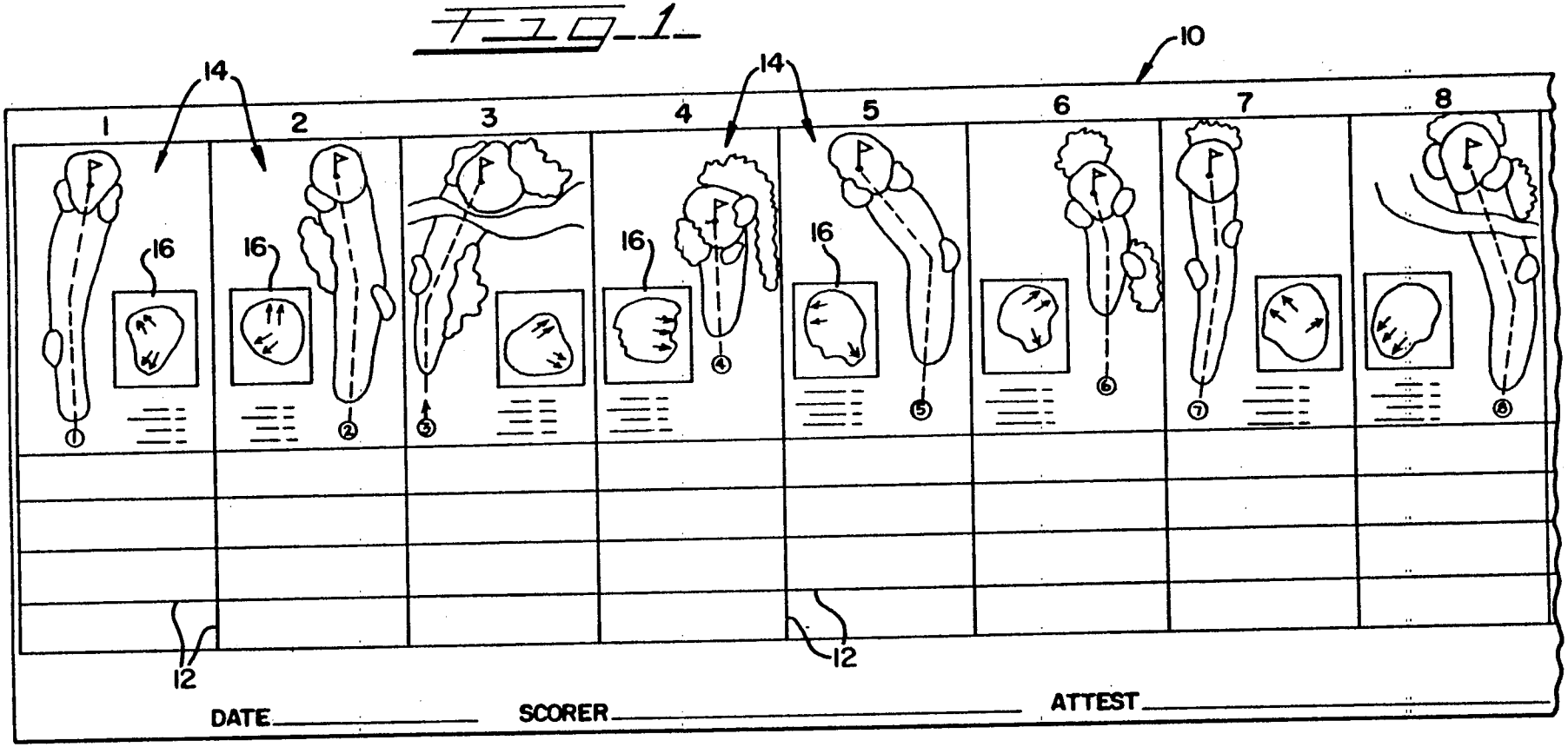
FIG. 1 is a fragmentary view of a golf score card embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference now to FIG. 1, therein is illustrated a golf score card 10 embodying the principles of the present invention. The card comprises a markable substrate, such as paper, paperboard, cardboard, or the like, and preferably includes a grid-like matrix 12 to facilitate keeping score on a hole-by-hole basis, preferably for several players.

As further illustrated in FIG. 1, score card 10 includes a plurality of graphic illustrations 14 each illustrating the general layout of one of the various holes of the associated golf course. As illustrated, each illustration 14 may be sufficiently detailed as to illustrate the relative position of the tee box for the hole, one or more bunkers, trees, streams, and like hazards and obstacles for the hole.

In accordance with the present invention, each graphic illustration 14 further includes a graphic depiction 16 showing the general shape of the putting green of the respective one of the golf holes. While the graphic depiction 16 in the illustrated embodiment is shown to be of a scale consistent with the scale of remaining portions of the graphic illustration 14 of the respective hole, it will be appreciated that the graphic depiction for the green may be of a different scale, such as relatively enlarged, while keeping with the principles of the present invention.

Figure 2:
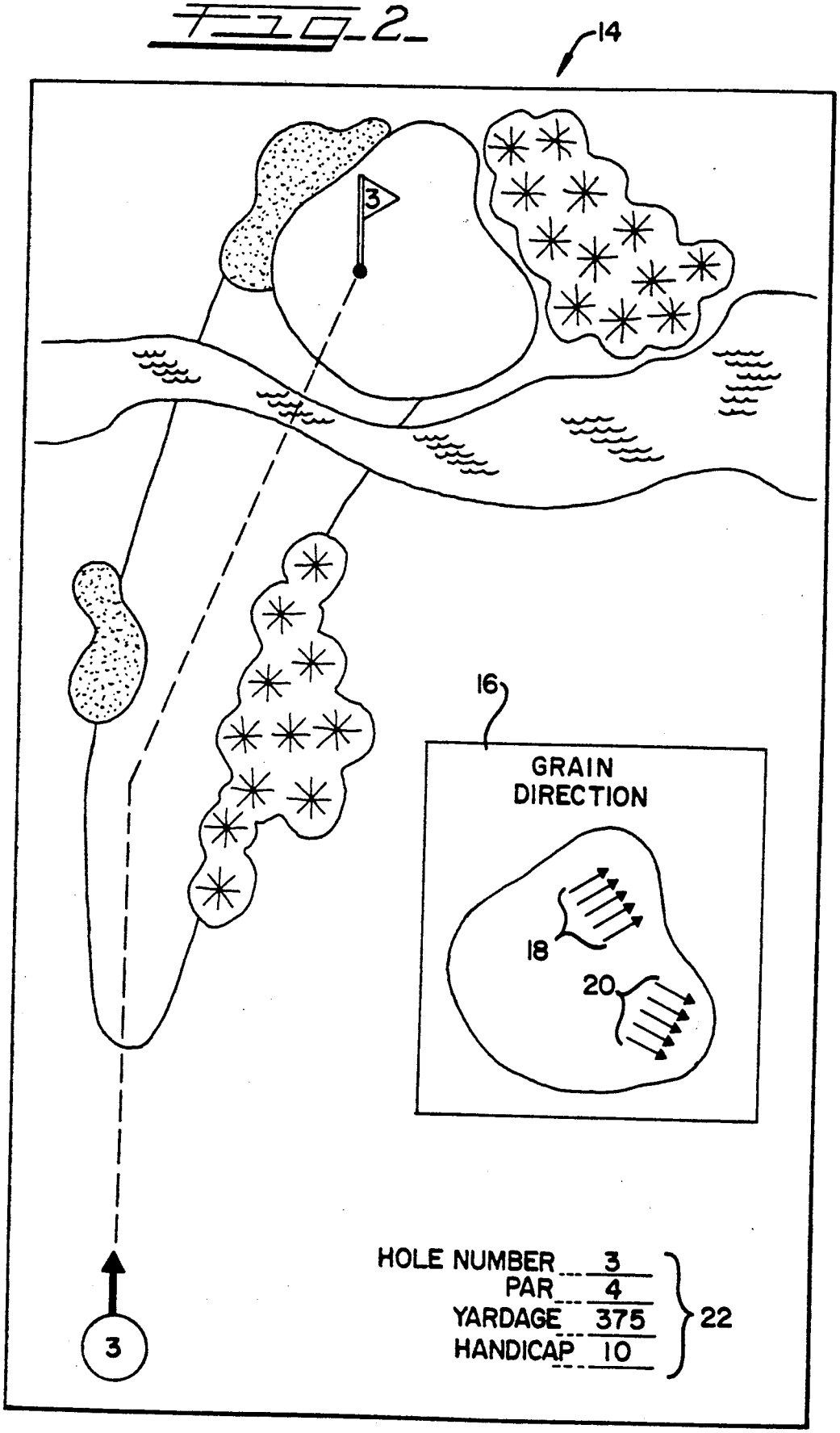
FIG. 2 is a relatively enlarged view of a portion of the golf score card illustrated in FIG. 1, showing a graphic depiction of one of the holes of the golf course, including a graphic depiction of the green of the hole with grain indicia for the putting surface of the green.

With particular reference to FIG. 2, the present invention contemplates that indicia 18 be provided in connection with the graphic depiction 16 of the green, wherein the indicia are configured and oriented for indicating the direction of the grain of the grass on the respective green. In accordance with the illustrated embodiment, the grain indicia 18 may take the form of a plurality of arrows, but it will be appreciated that other alternate markings may be suitably employed.

In the graphic illustration 14 shown in FIG. 2, it will be noted that another grain indicia 20 is provided on the graphic depiction 16. The plurality of grain indicia are intended to correspond to and indicate a respective plurality of directions of the grain of the grass on that green. This can be useful in assisting a player in evaluating the characteristics of a green where the grain tends to extend in more than one direction.

As shown in FIG. 2, other suitable course information can be provided, such as shown at 22, to assist the player and scorer using the golf score card 10.

From the foregoing, it will be observed that numerous modifications and variations can be effected without departing from the true spirit and scope of the novel concept of the present invention. It is to be understood that no limitation with respect to the specific embodiment illustrated is intended or should be inferred. The disclosure is intended to cover by the appended claims all such modifications as fall within the scope of the claims.

What is claimed is:

1. A golf score card for assisting players in calculating the play of the greens of a golf course, said score card comprising:

a markable substrate having provided thereon scoring means for entering the scores of at least one player on a hole-by-hole basis;

a plurality of graphic means provided on said markable substrate, each of said graphic means comprising a graphic depiction of the general layout of each golf hole of the golf course, and an associated graphic depiction of the boundary of the respective putting green of the hole to thereby depict the general shape of the respective green; and at least one grain indicia means associated with each of the graphic depictions of the putting greens of the golf course, for indicating the direction of the grain of the grass on the respective green, each said grain indicia means comprising at least one direction-indicating marking positioned within the graphic depiction of the boundary of the respective putting green.

2. A golf card in accordance with claim 1, including a plurality of grain indicia means associated with at least one of said green depicting means for indicating a respective plurality of directions of the grain of the grass on the green.

3. A golf card in accordance with claim 1, wherein each said direction-indicating marking comprises an arrow.

* * * * *